US010878693B2

(12) United States Patent
Ma et al.

(10) Patent No.: US 10,878,693 B2
(45) Date of Patent: Dec. 29, 2020

(54) TRAFFIC SIGNAL STATE PREDICTION CORRECTION AND REAL-TIME PROBE DATA VALIDATION

(71) Applicant: TRAFFIC TECHNOLOGY SERVICES, INC., Beaverton, OR (US)

(72) Inventors: Jingtao Ma, Portland, OR (US); Thomas Bauer, Beaverton, OR (US); Kyle Zachary Hatcher, Portland, OR (US); Alex Thomas Marineau, Hillsboro, OR (US)

(73) Assignee: TRAFFIC TECHNOLOGY SERVICES, INC., Beaverton, OR (US)

( * ) Notice: Subject to any disclaimer, the term of this patent is extended or adjusted under 35 U.S.C. 154(b) by 0 days.

(21) Appl. No.: 16/660,601

(22) Filed: Oct. 22, 2019

(65) Prior Publication Data

US 2020/0126406 A1 Apr. 23, 2020

Related U.S. Application Data

(60) Provisional application No. 62/891,152, filed on Aug. 23, 2019, provisional application No. 62/749,605, filed on Oct. 23, 2018.

(51) Int. Cl.

| | |
|---|---|
| ***G08G 1/123*** | (2006.01) |
| ***G08G 1/01*** | (2006.01) |
| ***G08G 1/0967*** | (2006.01) |

(52) U.S. Cl.

CPC ..... *G08G 1/0112* (2013.01); *G08G 1/0141* (2013.01); *G08G 1/096716* (2013.01);

(Continued)

(58) Field of Classification Search

CPC .. G08G 1/0112; G08G 1/0125; G08G 1/0129; G08G 1/0133; G08G 1/0141; G08G 1/0145

See application file for complete search history.

(56) References Cited

U.S. PATENT DOCUMENTS

2005/0080552 A1* 4/2005 Feldman ..... H04W 12/02 701/120
2011/0037619 A1* 2/2011 Ginsberg ..... G08G 1/096844 340/910

(Continued)

FOREIGN PATENT DOCUMENTS

EP 1615190 A2 1/2006
EP 2824647 A1 1/2015

OTHER PUBLICATIONS

"Connected Vehicles", retrieved from the internet on Oct. 17, 2019; https://trafficproducts.net/connected-vehicles (3 pages).

(Continued)

*Primary Examiner* — Qutbuddin Ghulamali
(74) *Attorney, Agent, or Firm* — FisherBroyles LLP; Micah D. Stolowitz

(57) ABSTRACT

Methods and systems to improve the accuracy of traffic signal state change predictions are disclosed. Predictions can be broadcast to vehicle drivers or autonomous systems to improve safety, fuel efficiency and reduce delays. Predictions for fixed-time signals are generated based on their scheduled timing plan and the current clock/time, but these predictions are subject variations, for example, due to traffic signal controller clock drift. Real-time actual, not predicted, data is collected and utilized to correct for these variations. Further, real-time probe data is collected and used to validate correctness of the generated predictions in real time. In one embodiment, GPS data from travelers' devices is utilized to assess validity of the generated predictions, looking particularly at signal stop line crossings relative to predicted green time window. If crossings observed in real time contradict the predicted signal state, the data service providing predictions to users may be suspended.

20 Claims, 6 Drawing Sheets

(52) U.S. Cl.
CPC . *G08G 1/096725* (2013.01); *G08G 1/096775* (2013.01); *G08G 1/096783* (2013.01); *G08G 1/123* (2013.01)

(56) References Cited

U.S. PATENT DOCUMENTS

2011/0095908 A1* 4/2011 Nadeem ..... B60H 3/00
340/905
2016/0098924 A1* 4/2016 Vahidi ..... G08G 1/0141
701/119

OTHER PUBLICATIONS

Perry, Frank, "UFTI DSRC and Other Communication Options for Transportation Connectivity Workshop: Overview of DSRC Messages and Performance Requirements", May 3, 2017 (34 pages).
Zhang et al., "Increasing Traffic Flows with DSRC Technology: Field Trials and Performance Evaluation".
"Intelligent Transportation Systems—ITS Deployments", retrieved from the internet on Oct. 17, 2019; https://www.its.dot.gov/pilots/roadside_unit.htm (2 pages).
Blokpoel and Vreeswijk, "Uses of probe vehicle data in traffic light control", Transportation Research Procedia ,14 ( 2016 ) 4572-4581.

* cited by examiner

TRAFFIC SIGNAL STATE PREDICTION CORRECTION AND REAL-TIME PROBE DATA VALIDATION

RELATED APPLICATIONS

This application is a non-provisional of U.S. Provisional Application No. 62/749,605 filed Oct. 23, 2018, and a non-provisional of U.S. Provisional Application No. 62/891,152 filed Aug. 23, 2019, both of which are incorporated herein by this reference.

COPYRIGHT NOTICE

Copyright © 2018-2019 Traffic Technology Services, Inc. A portion of the disclosure of this document contains material which is subject to copyright protection. The copyright owner has no objection to the facsimile reproduction by anyone of the document or the disclosure, as it appears in the Patent and Trademark Office file or records, but otherwise reserves all copyright rights whatsoever. 37 C.F.R. § 1.71(d) (2017).

TECHNICAL FIELD

This application is in the field of traffic engineering and pertains to methods, systems and software to generate accurate traffic signal state change predictions for use by drivers, autonomous vehicles and other users to improve traffic flow, safety and fuel efficiency.

BACKGROUND

Our U.S. Pat. No. 9,396,657 (Bauer, et al.) teaches methods and apparatus for prediction of traffic signal state changes. That patent discloses a computer software emulator to emulate operation of a field traffic signal controller (FSC) at a given location, utilizing its associated timing parameters, to predict state changes. Traffic signals run on scheduled timing plans at different times, by time of day, day of week, and holidays or special events. These timing plans and schedules are obtainable from local or regional agencies' central computers, databases, or hardcopy file archives that are used to enter the traffic signal controllers.

Our U.S. Pat. No. 10,008,113 (Ova, et al.) teaches a hybrid distributed system and method for prediction of traffic signal state changes and describes various techniques for related communications with moving vehicles. U.S. Pat. Nos. 9,396,657 and 10,008,113 are incorporated herein by this reference.

A technical problem remains: Traffic signal state changes can be predicted based on these schedules and timing plans. However, traffic signal controller hardware are impacted by unpredictable anomalies such as local clock drifts, or special control events such as signal preemptions (say, by a fire truck) or timing plan transitions. These often cause a deviation of the signal switches from planned (scheduled) ones as compared to the corresponding real-world occurrences.

The need remains for a way to more accurately predict actual traffic signal state changes for various applications including, without limitation, to assist drivers or autonomous vehicle systems, to improve safety, to improve fuel efficiency, etc. The need also remains to check or validate traffic signal state change predictions to ensure accuracy before they are disseminated.

SUMMARY OF THE PRESENT DISCLOSURE

The following is a summary of the present disclosure to provide a basic understanding of some features and context.

This summary is not intended to identify key or critical elements of the disclosure or to delineate the scope of the disclosure. Its sole purpose is to present some concepts of the present disclosure in simplified form as a prelude to a more detailed description that is presented later.

Methods and systems to improve the accuracy of traffic signal state change predictions are disclosed. Predictions for fixed-time signals are generated based on their scheduled timing plan and the current clock/time, but these preliminary predictions are subject variations, for example, due to traffic signal controller clock drift. Real-time actual, not predicted, data is collected and utilized to correct for these variations. Further, real-time probe data is collected and used to validate correctness of the generated predictions in real time. In one embodiment, GPS data from travelers' devices is utilized to assess validity of the generated predictions, looking particularly at signal stop line crossings relative to predicted green time window. If crossings observed in real time contradict the predicted signal state, the data service providing predictions to users may be suspended.

In an embodiment, a process comprises the steps of accessing a data store of traffic signal timing plans associated with a target traffic signal, accessing a data store of traffic signal schedules used for selecting one at a time of the traffic signal timing plans associated with the target traffic signal, based on a current date-time stamp and the traffic signal schedule, identifying one of the traffic signal timing plans as a currently selected timing plan, acquiring a preliminary prediction of a state change of the target traffic signal, the preliminary prediction generated utilizing the currently selected timing plan, identifying a traffic signal controller associated with the target traffic signal, acquiring traffic signal variation data for the traffic signal controller associated with the target traffic signal, adjusting the preliminary prediction based on the traffic signal variation data to form a corrected prediction of a state change of the target traffic signal, and using the corrected prediction to predict a state change of the target traffic signal. The corrected prediction may be transmitted to a vehicle.

In one aspect, the process of acquiring traffic signal variation data for the traffic signal controller may include generating baseline predictions based on timing plans, monitoring real-time state change events of the traffic signal controller, and recording the events along with corresponding timestamps, and comparing a timestamp of the baseline predictions with a timestamp of a corresponding real-time event to determine a deviation for the state change event. In some embodiments, deviation pattern libraries may be formed.

In a case that the deviations are caused by clock drift in the traffic signal controller, the deviation data may be applied to form the corrected prediction of a state change of the target traffic signal.

In another feature, the present disclosure describes validating the corrected prediction using real-time probe data; and subject to validation of the corrected prediction based on the real-time probe data, using the corrected prediction to predict a state change of the target traffic signal. Analysis of probe data with respect to stop line crossings can be compared to the prediction data to ensure it is valid before disseminating it.

BRIEF DESCRIPTION OF THE DRAWINGS

To enable the reader to realize one or more of the above-recited and other advantages and features of the present disclosure, a more particular description follows by reference to specific embodiments thereof which are illustrated in the appended drawings. Understanding that these drawings depict only typical embodiments of the disclosure and are not therefore to be considered limiting of its scope, the present disclosure will be described and explained with additional specificity and detail through the use of the accompanying drawings in which.

DETAILED DESCRIPTION OF PREFERRED EMBODIMENTS

Figure 1:
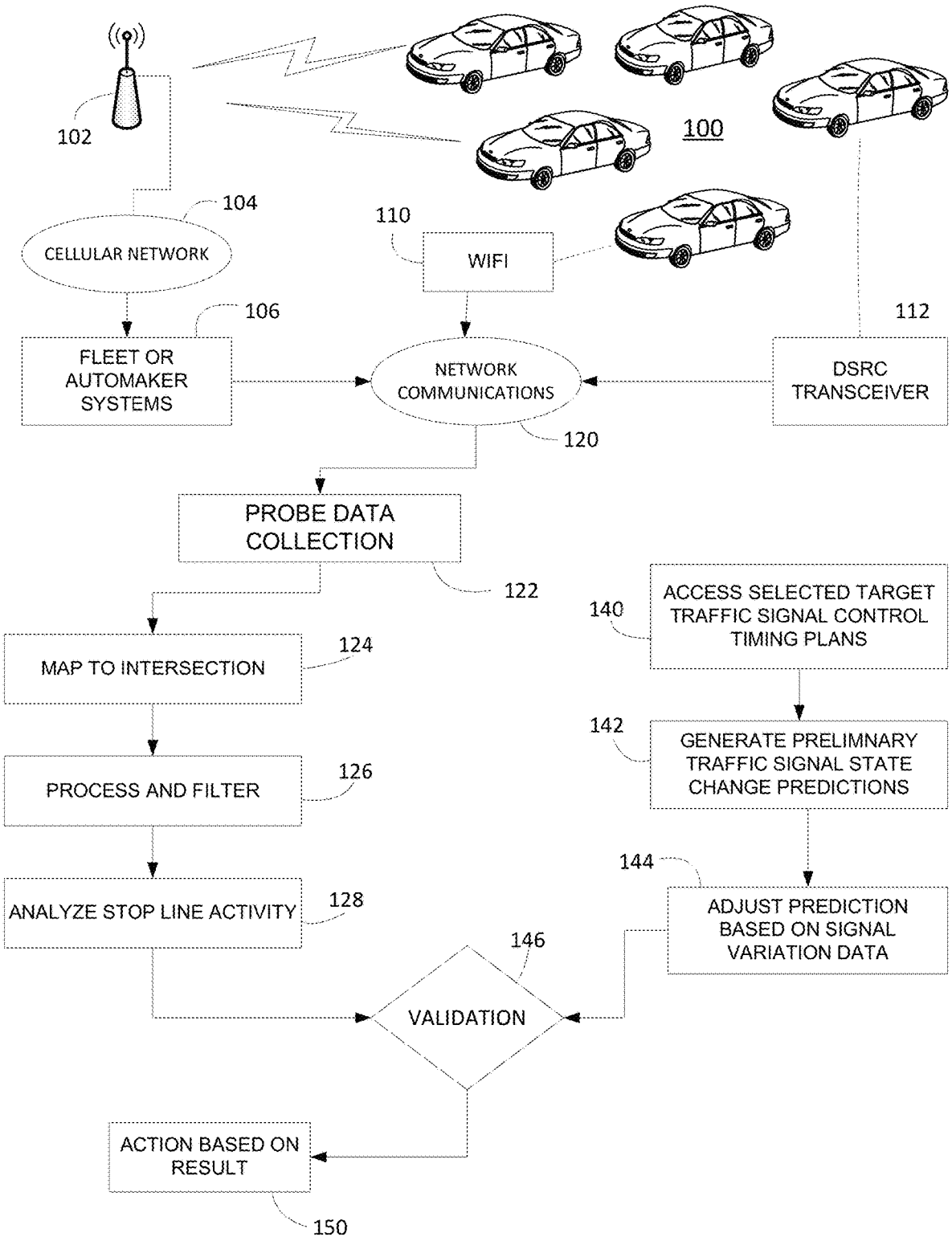
FIG. 1 is a simplified flow diagram of a traffic signal state prediction system.

Reference will now be made in detail to embodiments of the inventive concept, examples of which are illustrated in the accompanying drawings. The accompanying drawings are not necessarily drawn to scale. In the following detailed description, numerous specific details are set forth to enable a thorough understanding of the inventive concept. It should be understood, however, that persons having ordinary skill in the art may practice the inventive concept without these specific details. In other instances, well-known methods, procedures, components, circuits, and networks have not been described in detail so as not to unnecessarily obscure aspects of the embodiments. Like numbers refer to like elements throughout the various views and drawings. As used herein, the term "and/or" includes any and all combinations of one or more of the associated listed items.

The terminology used in the description of the inventive concept herein is for the purposes of describing illustrative embodiments only and is not intended to be limiting of the inventive concept. As used in the description of the inventive concept and the appended claims, the singular forms "a," "an," and "the" are intended to include the plural forms as well, unless the context clearly indicates otherwise. It will also be understood that the term "and/or" as used herein refers to and encompasses any and all possible combinations of one or more of the associated listed objects. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Glossary of Selected Terms

Traffic Signal or simply "Signal". Refers to a set of traffic control devices, including "signal heads" generally deployed at a single street intersection, highway ramp or other location. A traffic signal is controlled by an associated Field Signal Controller ("FSC").

Field Signal Controller ("FSC"). Refers to a controller, generally comprising electronics and/or software, arranged to control a Traffic Signal. The Field Signal Controller may be located at or near the corresponding Traffic Signal location, such as a street intersection, or at a central traffic management center, or some combination of the two. An FSC may operate according to various rules, algorithms, and inputs, depending on the location and circumstances of the signal it controls. For example, raw inputs may be provided to the FSC by a Detector.

Field Signal Controller State. Refers to the state of an FSC, for example, the status of one or more internal timers, and the state or status of one more Indicators controlled by the FSC. The FSC has a given state at a specific time.

Cycle Time. An FSC may change state according to a Cycle Time, although the cycle time may not always be constant. For example, a weekday cycle time may differ from a weekend cycle time for a given FSC.

Detector. Refers to an electrical, magnetic, optical, video or any other sensor arranged to provide raw input signals to an FSC in response to detection of an entity such as a motor vehicle, transit vehicle, bicycle or pedestrian. The input signal may correspond to the arrival, presence, or departure of the vehicle. A detector also may be activated manually, for example, by a pedestrian or a driver pressing a button. Of course, a detector also may be initiated remotely or wirelessly, similar to a garage or gate opener. In general, Detectors provide raw inputs or stimuli to an FSC.

Controller Emulator. Is discussed in more detail below, but in general may comprise computer hardware or other electronics, and/or software, wherever located, that is arranged to mimic or emulate the operation of an FSC.

Indicator. Refers to one or more signal lights or other visible and/or audible indicators arranged to direct or inform a user such as a motor vehicle driver, bicyclist, pedestrian, or transit vehicle operator at or near a given traffic signal location. A common Indicator for motor vehicles is the ubiquitous Green-Yellow-Red arrangement of lights. Typically, an Indicator is triggered or otherwise controlled by the FSC associated with the signal location.

Prediction. A prediction of a selected traffic signal state or state change. The complete state of a traffic signal includes, among other things, states of all of the signaling devices for all of the phases of the controlled intersection.

Phase. In a signal timing plan, for example, a Phase is "A controller timing unit associated with the control of one or more movements. The MUTCD defines a phase as the right-of-way, yellow change, and red clearance intervals in a cycle that are assigned to an independent traffic movement." So it refers to one or multiple movements that are allowed to go together under the signal control, for example, a northbound left turn can have its own (protected) phase. Or the northbound left turn can also be coupled with the northbound through (and right turn in that matter) and thus the entire northbound movements become one phase (in this case northbound left turn vehicles may have to find gaps between opposing southbound through traffic to cross the street).

Probe Data. Data provided most often by a vehicle, typically GPS traces, indicating the vehicle location and preferably speed and direction. Probe data provides real-time information about vehicle movements and locations. In some cases, probe data can be used to replace, or used in conjunction with, detectors such as ground loops, to provide dynamic information to a traffic signal controller. A "probe vehicle" refers to a vehicle that provides probe data. Specific probe data source examples are described later.

FIG. 1 is a simplified overview diagram of a traffic signal state prediction system. Here, a plurality of vehicles 100 are variously equipped to transmit data regarding their location, and typically speed and direction. Alternatively, speed and direction can be calculated in a server based on repeated location traces. In one example, some of the vehicles may transmit GPS traces. Some or all of the vehicles may transmit data over a radio channel to a wireless receiver antenna 102, for example, a cell tower. The cell tower antenna is coupled to a cellular carrier network 104 to receive the data. In one example SMS messaging may be used. The cellular network the transmits the raw data virtually in real-time to a backend server 106 provisioned by a fleet operator, automaker, or other entity. In some cases, they could use some local communication (WiFi, DSRC/LTE-V or in the future 5G) to temporarily store and then forward the data via either backhaul fiber or cellular network again to the backend. The fleet server 106 may filter and process the data, then transmit selected data, based on at least some of the raw data, over a communications network 120, which may be the Internet, WLAN, microwave, etc. FIG. 1 further illustrates a vehicle transmitting data (for example, GPS traces) to a WiFi router 110 which is turn is coupled to the network 120. Finally, the figure also illustrates a DSRC transceiver 112.

Not shown in FIG. 1 are fixed-location data sources, for example, camera/radar vendor/service providers, which also can be used to collect the raw data. For example, camera/radar image data can be processed and provided over the network 120. Collectively, these groups (mobile and fixed-location sources) can be called data providers to a data collection server 122. In some embodiments, the processes on these data providers mainly include anonymizing the individual traces. They could perform the required analysis 'red crossing validation,' described below, but they could also simply deliver the anonymized data to the server 122 which realizes additional processes including the following.

The probe data collection server 122, for a given intersection, filters and maps the incoming probe data (here we refer to probe data broadly as including both mobile and fixed-location sources) to the selected intersection, block 124. Of course, many processes may execute in parallel to provide predictions for many inter, sections. The data may be further processed and filtered, block 126, down to the individual phase level. To do so, the server may access MAP data from a database (not shown). In more detail, in a preferred embodiment, a server will maintain a geo-database, which includes the signal location, the stop lines, the signal phasing, the lane configurations (left turn, through, right turn), and the lane alignment. These data form collectively one set of messages, so-called MAP message defined by the Society of Automotive Engineers (SAE) J2735 standard. This MAP message is the basis to map the probe data to the certain traffic signal and its phases. The server thus develops time-stamped stop line crossing data, block 128, which is used to validate signal change predictions, decision 146, as described in more detail below.

At a high level, FIG. 1 further illustrates accessing timing plans and schedule for the selected intersection, block 140. Then the system generates preliminary predictions based on those plans, block 142, and finally, as explained in more detail below, the preliminary predictions are adjusted based on signal variation data, block 144. Finally, the adjusted prediction is checked or validated, decision 146, relative to the actual real-time stop line crossing information derived from the probe data at 128. The validation results are used to determine whether to use or not use the prediction, block 150.

Adjusting Preliminary Signal State Predictions to Improve Accuracy

Improvements to signal state predictions can be achieved by applying real-time actual (not predicted) data. Some real-time actual data are available from periodic or opportunistic data sources. These data sources may include:

- Traffic signal state (bulb color) switch events. These events refer to the signal bulb color changes in the signal head, for example, green-amber-red sequence in the typical 3-face signal head; or change from a protected phase (indicated by green arrow for right or left turns) to a permissive phase (indicated by flashing yellow arrow, or solid green ball).]
- Cameras from mobile devices (smart phones or tablets) mounted on vehicle dashboard, or vehicle onboard devices (WiFi, DSRC OBUs, or cameras).

In some instances, observed signal state switch events can be derived from other so-called crowd-sourced data, such as GPS probes. For example, with certain data cleaning method, the green start times of a certain phase can be derived from filtered the GPS traces of probe vehicles. These derived green start times can also serve as observed event input to this prediction approach. These data capture the exact moment as certain traffic controller events occur in real time. These controller events and their timestamps may be recorded and utilized to advantage as described in the following example:

Collecting and Analyzing Clock Drift Data

Step 0: In this process, one may first survey the controller firmware, and central system clock arrangements. Controller firmware from different vendors have their own way of maintaining the clock and its synchronization. Their timestamp precisions may be only on seconds, even though the event reporting itself is on milliseconds. For example, the report of an event (say, signal green-yellow state change) can be at 10:20:35.700, for the event occurrence time of 10:20:35, but the reported event itself is only updated every second. In other words, the event itself could have happened at 10:20:34.051, or 10:20:35.049 (assuming rounding to the nearest integer of second, i.e., 10:20:35). Most controller clocks and control parameter definitions run on 1/10 second; so, if a controller event precision is one second as above, these parameters will be rounded. For these reasons, it may have already introduced a systematic error of 1 second in event reporting.

If a field signal controller is connected to central system, central systems can synchronize the controller clock to the central system time. This may happen a few times a day, or once a day, or every hour, depending on the central system. The less frequent of synchronization, the more drifts the controller clock may see (because of power grid frequency oscillation accumulation errors). Therefore, knowing the central system field controller clock synchronization frequency will assist in determining the drift patterns of these systems and controllers.

In an embodiment, our process includes accumulation (storage) of real-time controller events and timestamps, and assessing the deviations of real time signal operation from control plans. In an embodiment, the process calls for determining a deviation threshold for different patterns as an indicator of when to distrust the timing plan. One method to derive the threshold is to analyze the accumulated set of observed signal state switch events and use the statistics from these analyses. For example, one can collect all available observed events for either a target period (e.g., daytimes or night times, or signal timing plans), and compute the deviations from each corresponding baseline prediction. For this target period, we can find a set of statistics values, such as average, median or other percentile (85%-tile, 90%-tile).

Typically, the median can be used. Further similar analysis can be done for different target period, or over all times. The derived threshold values will then apply to its corresponding target period and, again, provide an indication of when the baseline prediction is not reliable. For some applications, we have found three seconds to be a useful threshold deviation value. An illustrative process may proceed as follows:

Step 1: From the schedule and timing plans, generate baseline predictions for all relevant controller events that can be observed from online data. Here, "online data" refers to real-time data that are available from periodic or opportunistic data sources. These data sources may include one or more of traffic signal state (bulb color) switch events, cameras from mobile devices (smart phones or tablets) mounted on vehicle dashboard, or vehicle onboard devices (WiFi, DSRC OBUs, or cameras). These examples are merely illustrative and not limiting. These data capture the exact moment as certain traffic controller events occur in real time. These controller events and their timestamps are recorded.

Step 2: For each real-time data event, capture and store the event and timestamp. Then do the following—

Step 2a: Check the timestamp of the baseline predictions, and compare with the online event timestamp, to obtain a deviation or "delta" and Step 2b: Determine the cause of the deviation, at least in part by comparing to the deviation threshold value.

Causes of deviations are likely to be: 1) signal controllers could have clock drift, or others that cause the inaccurate timestamps in the actual event from planned ones; 2) signal controller could have special events such as plan transitions; 3) timing plan changes that are not reflected in the baseline predictions.

Step 3: Use the derived threshold value to correct the corresponding baseline predictions, and keep using the corrected prediction till next event update.

Step 4: If the deviation pattern is not recognized, or deviations are higher than stored threshold values, send alert to re-start collecting data, Step 0, and discard current predictions.

Clock Drifts

Figure 2:
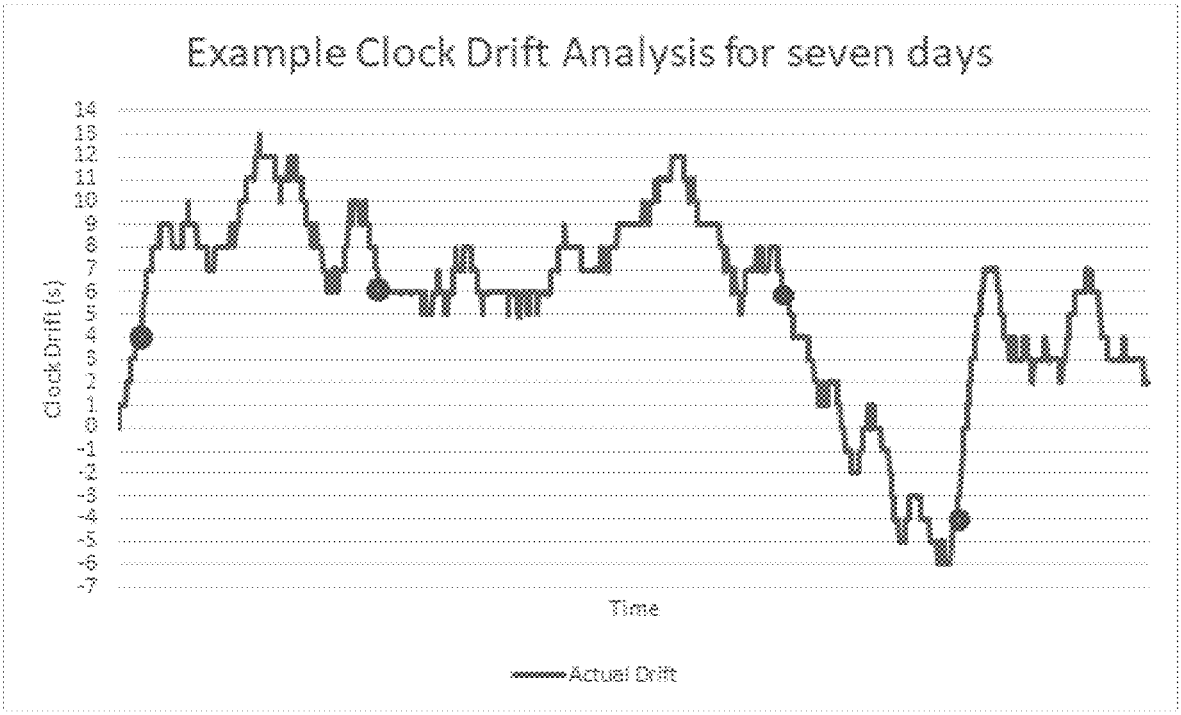
FIG. 2 is a plot illustrating actual clock drift in a traffic signal controller.

An important part of constructing clock drift and correction data is to determine whether the signal clocks are frequently adjusted or not. Signal controller clocks all drift; yet, if the agencies have work procedures or programs to adjust the clock, for example, regularly push the central system clock to the signal controller, then the clock drifts are adjusted based on that regular frequency. But if the agencies don't have such program established, the clock can drift significantly. FIG. 2 is one example of actual clock drifts throughout a selected week period.

As seen from FIG. 2, which shows actual drift of a signal controller clock, the continuous monitoring shows significant drifts across a time span of seven days. If a significant sample data of signal switches (indicated as round dots) are collected, they will show the drift compared to the signal switches predicted from timing plans.

In a case of continuous monitoring, to decide a particular signal controller clock drifts (with no regular synchronization), we determine whether the standard deviation of the clock drifts exceeds a predetermined threshold value. The threshold value may be selected empirically. It may vary with location of the control system. Typically, the threshold value will be in a range of 1-5 seconds; we have found the value of 3 seconds to be effective in various applications.

In a case of random samples of signal switch data, the following conditions must be met to determine clock drift correction is needed:

1. Switch times collected from timing plan changes period is excluded from the measurement.
2. At least 30 sample data were collected;
3. The standard deviation of the clock drifts is greater than the selected threshold.
4. In a case that the signal is identified as receiving no regular (periodic) clock synchronization, the threshold value is set to unlimited. If a signal is identified as having regular clock synchronization, its threshold is set as above, in a range of 1-5 seconds, and preferably 3 seconds.

Timing Plan Change

Timing plan changes happen when the traffic signal controller reaches the scheduled transition points between different programs. Different controller vendors, different firmware versions may have various implementations for how the controller adjusts the parameters from one plan/program to another. The combination of parameters (offset, cycle lengths, phasing sequence), and the controller types/versions make the signal timing behavior deviate from either side of the plans very differently. Therefore, when either the continuous or opportunistic sample signal switch data is validated against the plans, it is difficult to make any corrections. Typically, these timing plan change times last several signal cycles.

In this case, the library keeps the time-of-day and day-of-week/holiday schedule info; the typical timing plan change algorithm is kept in the library; the typical time or the number of signal cycles needed to complete the plan transition is kept in the library.

When the continuous or opportunistic signal switch sample data comes in, the clock is compared to the above info (schedule, plan transition method and typical length of transition). When the following conditions are met: The plan transition time completes; and the time difference between the signal switch in the new plan/program and the one from the baseline prediction is less than the threshold. The timing plan change is considered complete for this signal, and the prediction for the new plan can be used going forward until the next change.

Figure 6:
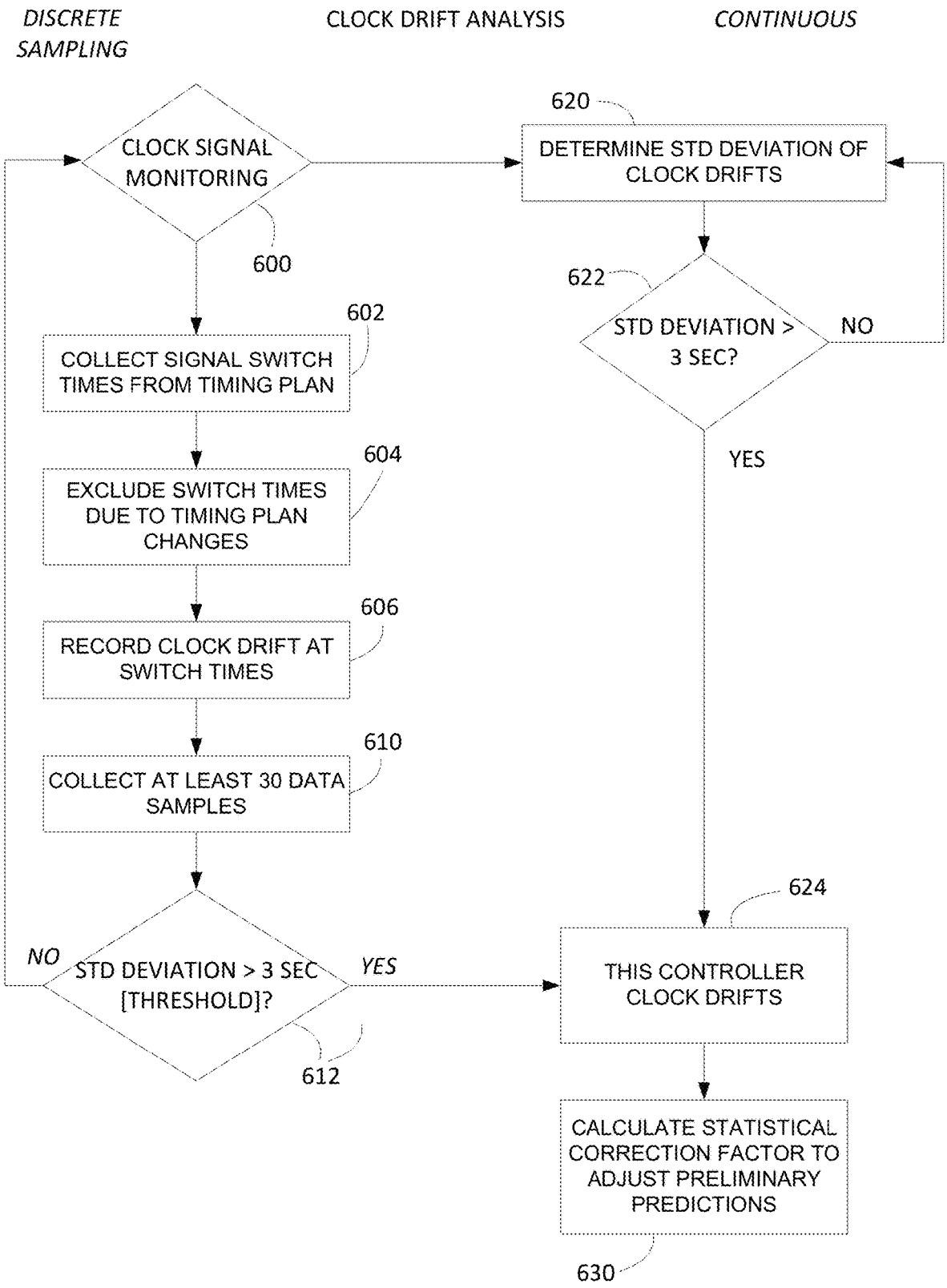
FIG. 6 is a simplified flow diagram of one example process to identify traffic signal controllers where prediction corrections are needed due to clock signal deviations.

FIG. 6 is a simplified flow diagram of one example process for clock drift analysis. Clock signals are monitored, decision block 600. In the case of discrete sampling, the process calls for collecting signal switch times for the current period from the subject signal timing plan, block 602. Switch times potentially affected by timing plan changes or transitions (for example, driven by timing plan scheduling) should be excluded, block 604. Then the clock drift delta or deviation is recorded at the signal state change or switch times, block 606. A meaningful number of data samples should be collected, for example, at least 30 data samples, block 610. After that is completed, statistical analysis of the data, for example, standard deviation of the clock time deviations (deltas) may be determined. The statistical value is compared to a predetermined threshold value, for example, in a range of 1-5 seconds, preferably 3 seconds, decision 612. If the statistical value, say standard deviation or sigma, exceeds the selected threshold value, for example, three seconds, the conclusion is reached that the subject controller clock signal drifts significantly, block 624. If the statistical metric does not exceed the threshold value, the process loops back from decision 612 to continue or resume monitoring, block 600.

Referring again to FIG. 6, in the case of continuous clock monitoring, the process calls for analyzing the monitored clock signal and determining a standard deviation of that signal, block 620. The standard deviation is compared to a predetermined threshold value, decision 622. The threshold value may be, for example, in a range of 1-5 seconds, preferably 3 seconds. If the standard deviation exceeds the selected threshold value, for example, three seconds ("YES"), the conclusion is reached that the subject controller clock signal drifts significantly, block 624. Accordingly, the process calculates a correction value or factor to adjust preliminary state change predictions for the subject controller.

Predicting Traffic Signal "Switches" or State Changes

Some traffic signals operate on a fixed schedule, while some others are "actuated" or may be adaptive to various conditions. In general, a traffic signal controller adapts to current traffic conditions and various inputs according to a predetermined signal timing plan.

Connecting vehicles to the traffic signal infrastructure is a new concept that promises to reduce fuel consumption and save time. We described herein various methods and apparatus to accomplish this functionality. The embodiments described below are not intended to limit the broader inventive concept, but merely to illustrate it with some practical implementations. The ongoing improvements in related technologies, such as cloud computing, wireless data communications, vehicle head units, video, etc. will enable further embodiments in the future that may not be apparent today, but nonetheless will be equivalent variations on our disclosure, perhaps leveraging newer technologies to improve speed, lower cost, etc. without departing from our essential inventive concept.

Some communication infrastructure is necessary to deliver various "signal data" (for example, states, timers or predictions) into a (potentially moving) vehicle in real-time. Preferably, the vehicle (or its operator) not only is informed about the current status of the signal, but also what the signal is going to do in the near-term future. Predictions of traffic control signal status and or changes can be utilized to advantage by a vehicle control system, either autonomously or with driver participation. Predictions of traffic control signal status and or changes can be utilized by a vehicle operator independently of a vehicle control system. One important aspect of the following discussion is to describe how to create accurate and reliable traffic signal predictions and deliver them to a vehicle/driver in a timely and useful manner.

Predictions of traffic control signal status and or changes may be delivered to a vehicle in various ways, for example, using the wireless telecom network, Wi-Fi, Bluetooth or any other wireless system for data transfer. Any of the above communication means can be used for communication to a vehicle, for example, to a "head unit" or other in-vehicle system, or to a user's portable wireless device, such as a tablet computer, handheld, smart phone or the like. A user's portable device may or may not be communicatively coupled to the vehicle. for example, it is known to couple a mobile phone to a vehicle head unit for various reasons, utilizing wired or wireless connections.

Predictions of traffic control signal status and or changes may be displayed for a user on a vehicle dashboard, head unit display screen, auxiliary display unit, or the display screen of the user's portable wireless device, such as a tablet computer, handheld, smart phone or the like. As an example, a prediction that a yellow light is going to turn red in two seconds may be provided to a driver and/or to a vehicle that is approaching the subject intersection.

Figure 5:
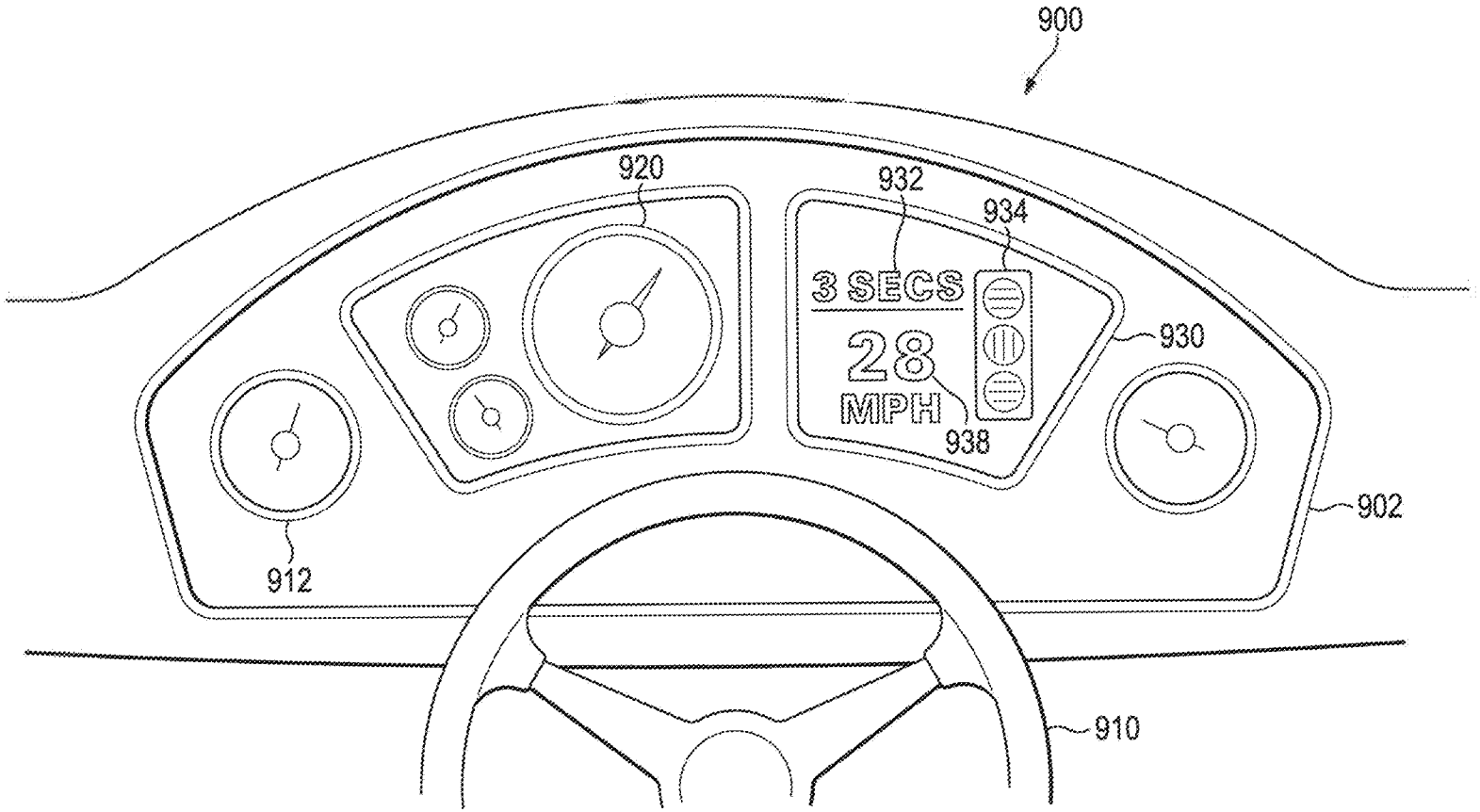
FIG. 5 shows an example of a traffic signal prediction display in a vehicle dashboard.

FIG. 5 shows an example of a traffic signal prediction display (930) in a vehicle dashboard. In FIG. 5, a vehicle dashboard is indicated generally at 900. Dashboard 900 may include an instrument panel 902, comprising various gauges or instruments 912, and typically a speedometer 920. A steering wheel 910 is shown (in part) for context. A traffic signal prediction display 930 in this example may comprise a time display 932 ("3 SECS") and a signal display 934. For example, the signal display 934 may comprise three light indicators. They may be red, yellow and green, and they may be arranged like the signal lights in a typical intersection traffic control signal.

It is not critical, however, that the light indicators be arranged in that manner, or that colored lights are used at all. Various visual display arrangements other than this example may be used; and indeed, audible signaling (not shown) may be used as an alternative, or in addition to, a visual display. The essential feature is to convey some traffic signal prediction information to a user. For example, in FIG. 5, the time display 932 may indicate a number of seconds remaining until the traffic signal that the vehicle is approaching is expected to change state, say from yellow to red. In some embodiments, the traffic signal prediction display 930 may include a speed indicator 938 ("28 MPH"). This may be used to indicate a speed calculated for the vehicle to reach the next signal while it is in the green state.

Knowledge of what an upcoming traffic signal is going to do in the near future can be used to save gas, save time, and reduce driver stress. For example, when the wait at a red light is going to be relatively long, the driver or an on-board control system may turn off the engine to save fuel. And the prediction system will alert the driver in advance of the light changing to green, to enable a timely restart of the engine. Or, a driver or control system may adjust speed to arrive at a green light. Travel time may be saved by routing optimizations that are responsive to anticipated traffic signal delays. Toward that end, the database prediction data may be provided to a mapping application. Stress is reduced as a driver need not continuously stare at a red signal light, waiting for it to change. In fact, if the wait is known to be long, the driver may want to check her email or safely send a message.

There are various ways to communication current traffic signal status to a vehicle. One of them is DSRC-explained in detail below. The DSRC system, when deployed in connection with a traffic signal, broadcasts a current signal status (RYG) in real-time to all nearby vehicles or other entities equipped to receive it. In locations where DSRC is deployed, we can take advantage of that information, which has negligible latency, and marry it the prediction methodologies described above. Real-time signal status can be used advantageously to update or synchronize a prediction process, avoiding the uncertain latency of data flow from a signal controller, and/or local traffic management center, to a central prediction system.

Corrections to Preliminary State Change Predictions

Figure 3:
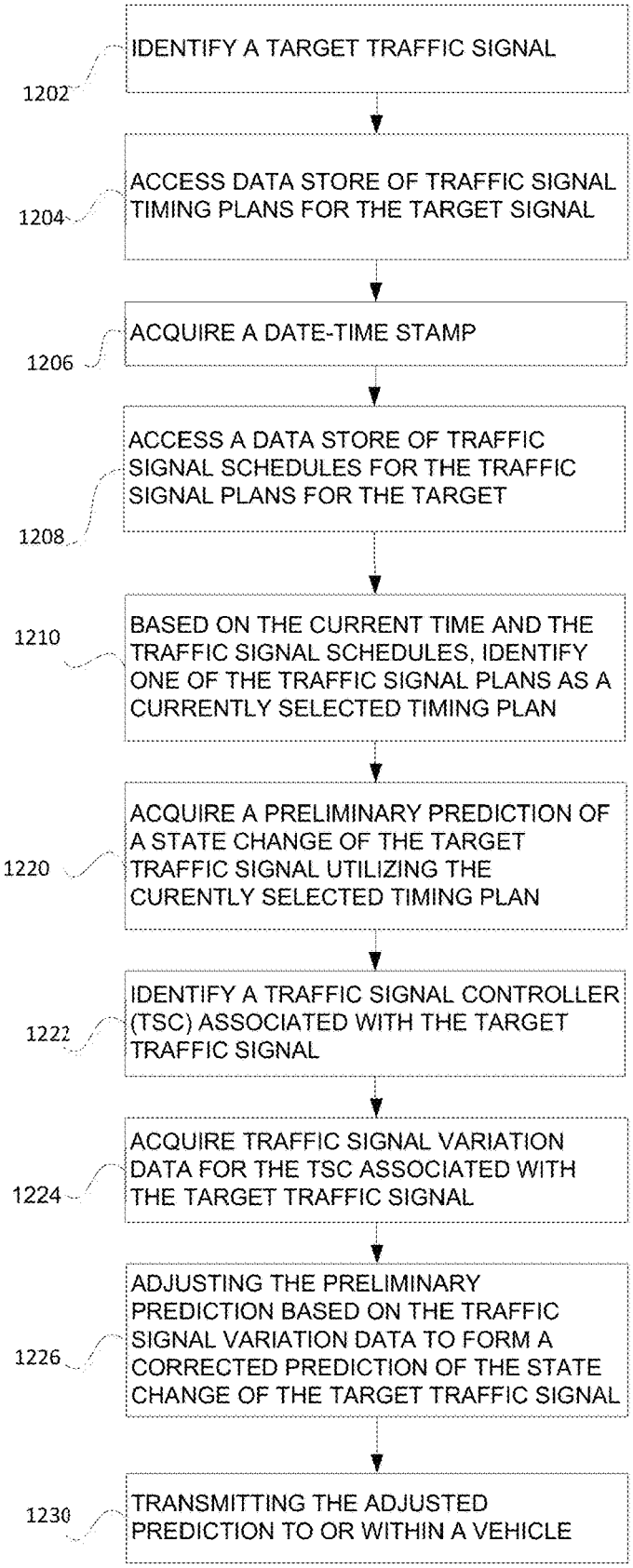
FIG. 3 is a simplified flow diagram of an example process for traffic signal state change prediction utilizing control plans and data correction.

FIG. 3 is a simplified flow diagram of an example process for traffic signal state change prediction utilizing control plans and data correction. This process must be implemented in software due to the timing constraints where seconds count. For example, a driver or an autonomous vehicle control system may receive a prediction that the signal light is it approaching will remain green for three seconds—sufficient time to safely clear the intersection. If the prediction is off by three seconds, the signal may immediately and unexpectedly turn yellow, potentially creating an unsafe situation where the driver is unsure whether to attempt to stop or not.

In the figure, the process first identifies a target traffic signal, block 1202. The target traffic signal may be the signal controlling an intersection that a vehicle is approaching, based on GPS, on-board navigation or other means. The software accesses a data store of traffic signal controller timing plans for the identified target signal, block 1204. The process acquires a date-time stamp of the current time, block 1206. Then the process accesses a data store of traffic signal schedules for the target traffic signal plans, block 1208. Based on the current time and the traffic signal schedules, the process next identifies one of the traffic signal plans as a currently selected timing plan for the target traffic signal, block 1210.

Next the process acquires a preliminary prediction of an upcoming state change of the target traffic signal, utilizing the currently selected timing plan and date-time stamp, block 1220. The process identifies a traffic signal controller (TSC) associated with, i.e., responsible for operating the target traffic signal, block 1222. The process further acquires previously-stored traffic signal variation data for the TSC associated with the target traffic signal, block 1224. The process then adjusts the preliminary prediction based on the acquired traffic signal variation data to form a corrected prediction of the state change of the target traffic signal, block 1226. Finally, the process transmits the corrected prediction to a vehicle, or within a vehicle, or to another user of the prediction.

Figure 4:
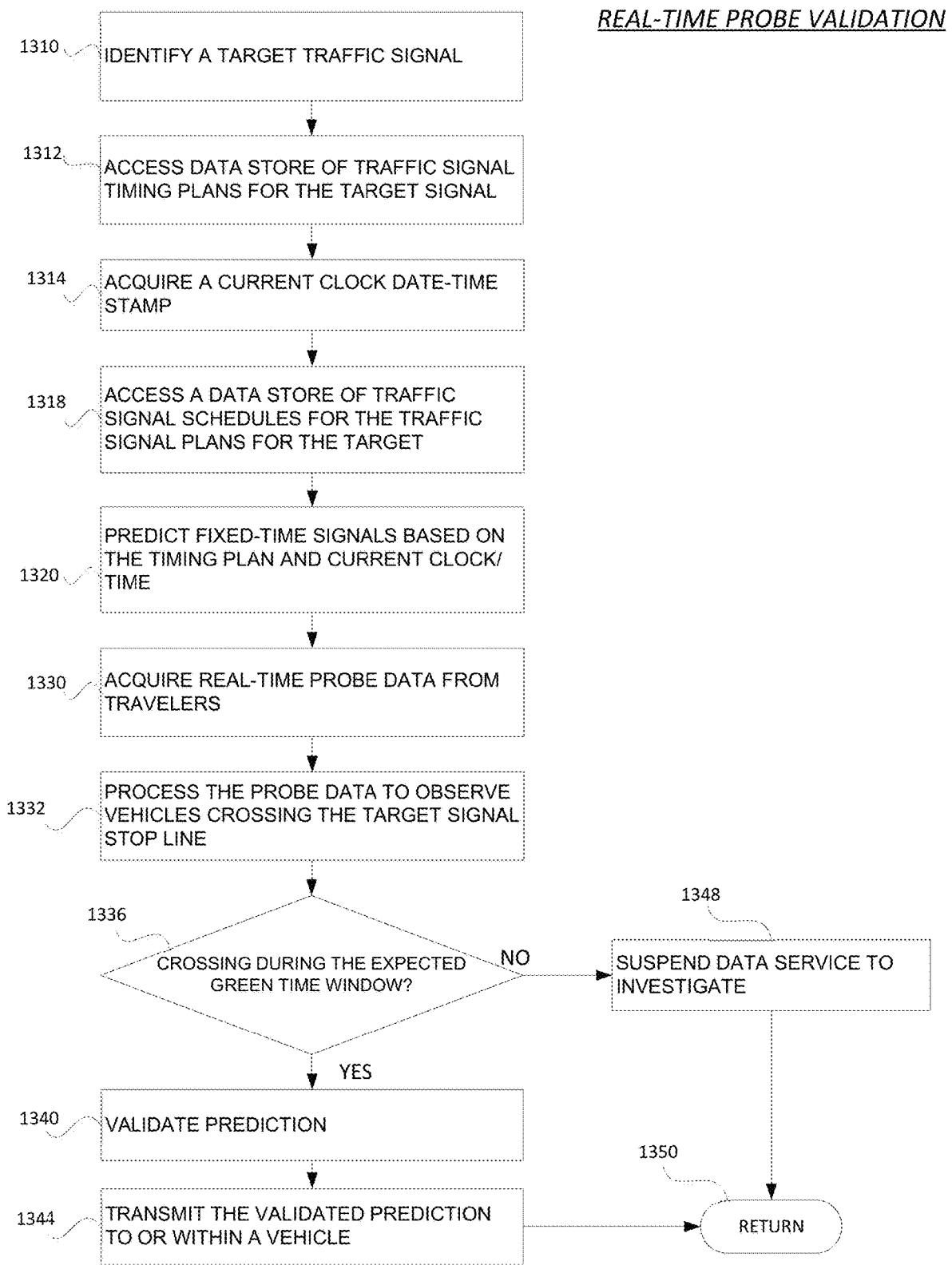
FIG. 4 is a simplified flow diagram of an example process for traffic signal state change prediction validity testing using real-time probe data.

FIG. 4 is a simplified flow diagram of a process to utilize Real-time Probe Data to validate traffic signal state change predictions. The process illustrated in the drawing is best understood in view of the disclosure above. In sum, the process may be considered a modification to what is described above regarding predictions. Basically, according to this modification, we predict fixed-time signals based on their timing plan and the current clock/time as explained earlier. We then use real-time probe data from any source to validate their correctness in real time. In other words, we observe the behavior of travelers, for example, from their GPS data, to judge the validity of our predictions. If all (or almost all) of the GPS probes cross the signal stop line during the expected green time window, then the prediction is valid. But if we observe them crossing when we think the signal should be red, then we discontinue our data service until we can investigate the cause (for example a timing plan change).

Referring to FIG. 4, the illustrative process begins, the process first identifies a target traffic signal, block 1310. The target traffic signal may be the signal controlling an intersection that a vehicle is approaching, based on GPS, on-board navigation or other means. The software accesses a data store of traffic signal controller timing plans for the identified target signal, block 1312. The process acquires a date-time stamp of the current time, block 1314. Then the process accesses a data store of traffic signal schedules for the target traffic signal timing plans, block 1318. Based on the current time and the traffic signal schedules, the process next identifies one of the traffic signal plans as a currently selected timing plan for the target traffic signal, block 1210. Then, predict fixed-time signal changes based on the selected timing plan and current time, block 1320. The process further acquires real-time probe data from vehicles in the vicinity of the target traffic signal, block 1330. The data from other vehicles may include GPS location, destination, speed and direction vectors, etc. Which vehicles are near or approaching a target traffic signal can be estimated by mapping GPS location to signal controller maps and data.

Analysis of the probe data can indicate, for example, a volume of traffic, and speed of the traffic, in a given location. The location can be mapped using known GPS methods down to the specific lane of travel. In particular, the probe data is processed to observe vehicles crossing the target signal (phase) stop line. Vehicles crossing the stop line (or limit line) especially at a significant speed, are a good indicator that the corresponding traffic signal control light is green at that time. If the data indicates traffic crossing during the expected green time window, that is, the green time window according to the predicted fixed-time signal change data (block 1320), decision 1336 (yes), this validates the prediction, block 1340. Then the validated prediction data is released or transmitted to a vehicle, within a vehicle, or to another consumer of the prediction data.

Transmission "within a vehicle" refers to the case where an on-board processor is involved in the prediction process, or at least the validation process, and that on-board processor passes the validated prediction data (over a wired or wireless connection) to a user interface such as the dashboard, entertainment center audio, navigation system, or other on-board systems. Other on-board systems may include autonomous or semi-autonomous control systems.

If the decision 1336 is NO, the probe data may contradict the initial prediction data. For example, if the probe data indicates that vehicles are stopped behind the stop line, it is a strong indicator that the control signal light is red, even though the current prediction indicates a green time window. In this case, the system may suspend prediction service until the problem can be investigated, block 1348. It is preferable to have no prediction rather than an erroneous prediction in the traffic control context. The illustrated process loops or returns at terminus 1350.

One of skill in the art will recognize that the concepts taught herein can be tailored to a particular application in many other ways. In particular, those skilled in the art will recognize that the illustrated examples are but one of many alternative implementations that will become apparent upon reading this disclosure. It will be obvious to those having skill in the art that many changes may be made to the details of the above-described embodiments without departing from the underlying principles of the invention.

The invention claimed is:

1. A method for correcting traffic signal state predictions comprising the steps of:

accessing a data store of traffic signal timing plans associated with a target traffic signal;

accessing a data store of traffic signal schedules used for selecting one at a time of the traffic signal timing plans associated with the target traffic signal;

based on a current date-time stamp and the traffic signal schedules, identifying one of the traffic signal timing plans as a currently selected timing plan;

acquiring a preliminary prediction of a state change of the target traffic signal, the preliminary prediction based on the currently selected timing plan;

identifying a traffic signal controller associated with the target traffic signal;

acquiring traffic signal variation data for the traffic signal controller associated with the target traffic signal;

adjusting the acquired preliminary prediction based on the traffic signal variation data to form a corrected prediction of the state change of the target traffic signal; and using the corrected prediction to predict a state change of the target traffic signal.

2. The method of claim 1 and further transmitting the corrected prediction to a vehicle.

3. The method of claim 1 wherein acquiring traffic signal variation data for the traffic signal controller associated with the target traffic signal includes:

generating baseline predictions for selected controller events based on the traffic signal timing plans and corresponding timing plan schedules;

monitoring real-time state change events of the traffic signal controller, and recording the events along with corresponding timestamps;

comparing a timestamp of a baseline prediction to a timestamp of a corresponding real-time event to determine a deviation datum for the state change event;

repeating the comparing step for additional real-time events to acquire additional deviation data;

determining whether the deviations in the deviation data are caused by clock drift in the identified traffic signal controller; and in a case that the deviations are caused by clock drift in the traffic signal controller, adjusting the baseline prediction based on the deviation data to form the corrected prediction.

4. The method of claim 3 wherein adjusting the preliminary prediction is by an average amount of the deviations in the deviation data.

5. The method of claim 3 including:

in a case the clock signal drift is determined as having no regular clock synchronization, setting a deviation threshold for the corresponding pattern to unlimited; and in a case the clock signal drift is determined as having a regular clock synchronization, setting the deviation threshold for the corresponding pattern to a predetermined value in a range of 1-5 seconds.

6. The method of claim 3 wherein acquiring traffic signal variation data for the traffic signal controller associated with the target traffic signal includes:

accumulating real time controller events;

determining a deviation for each controller event based on timestamps; and determining a cause of each of the deviations at least in part by comparing the deviation to a predetermined threshold value.

7. The method of claim 6 wherein the predetermined threshold value is estimated by:

monitoring and recording clock drift amounts for the traffic signal controller to form actual clock drift data over a selected time period;

analyzing the actual clock drift data to form a standard deviation of the clock drifts;

using the standard deviation as the predetermined threshold value.

8. The method of claim 7 wherein the monitoring clock drift amounts for the traffic signal controller to form actual clock drift data is conducted substantially continuously or periodically during the selected time period.

9. The method of claim 6 including:

collecting GPS probe signals transmitted from GPS probe vehicles to form crowd-sourced data;

filtering the crowd-sourced data to derive a green start time of a selected phase of the target traffic signal; and providing the derived green start time as one of the real-time controller events.

10. The method of claim 6 including:

counting a number of the recorded random sample data of signal switches that were not excluded;

in a case that the counted number exceeds a predetermined minimum number of sample data, analyzing the sample data to form a standard deviation of the sample data;

comparing the standard deviation of the sample data to a predetermined threshold deviation value; and if the standard deviation exceeds the predetermined threshold deviation value, designating the traffic signal controller as having clock drift (with no regular synchronization); and adjusting the preliminary prediction to form a corrected prediction of a state change of the target traffic signal.

11. A method comprising:

selecting a target traffic signal under control of a corresponding traffic signal controller;

based on a current date-time stamp, accessing a currently selected timing plan for the target traffic signal;

acquiring a preliminary prediction of a state change of the target traffic signal, the preliminary prediction generated based on the currently selected timing plan and the current date-time stamp;

acquiring traffic signal variation data for the traffic signal controller;

adjusting the acquired preliminary prediction based on the traffic signal variation data to form a corrected prediction of the state change of the target traffic signal;

validating the corrected prediction using real-time probe data; and subject to validation of the corrected prediction based on the real-time probe data, using the corrected prediction to predict a state change of the target traffic signal.

12. The method of claim 11 further including, if the corrected prediction is not validated based on the real-time probe data, suspending dissemination of the prediction of the state change of the target traffic signal.

13. The method of claim 11 wherein validating the corrected prediction based on the real-time probe data includes:

acquiring probe data from a plurality of probe data sources;

mapping the probe data to an intersection controlled by the target traffic signal, the intersection including a stop line;

processing the probe data to observe vehicles crossing the target traffic signal stop line;

comparing the vehicles crossing the stop line to a green time window provided by the corrected prediction, to determine to what extent vehicles are crossing the stop line during the predicted green time window;

validating the corrected prediction based on a result of the comparing step.

14. The method of claim 13 wherein the plurality of the probe data sources include, for a vehicle, at least one of an on-board GPS system, an on-board navigation system, a camera installed in a mobile device mounted on the vehicle dashboard, or a GPS system integrated in a mobile device located in the vehicle.

15. The method of claim 13 wherein the probe data sources include vehicle onboard devices including WiFi, Dedicated short-range communications (DSRC), Onboard Units (OBUs), or cameras.

16. The method of claim 13 including:

receiving real-time data from at least one fixed-location device located at the intersection, the fixed-location device arranged to record vehicle movements at a phase of the intersection;

processing the fixed-location device data to observe vehicles crossing the target traffic signal phase stop line; and basing the validation step, at least in part, on the processed fixed-location device data.

17. The method of claim 16 wherein the at least one fixed-location device comprises a camera, video camera, radar or lidar.

18. The method of claim 13 further comprising transmitting the validated corrected prediction to a vehicle in a vicinity of the target traffic signal.

19. The method of claim 18 including transmitting the validated corrected prediction via a DSRC transmission.

20. The method of claim 11 wherein validating the corrected prediction based on the real-time probe data includes:

acquiring probe data from a plurality of probe data sources located near an intersection controlled by the target traffic signal, the intersection including a stop line;

processing the probe data to observe vehicles crossing the target traffic signal stop line;

comparing the vehicles crossing the stop line to a predicted red-light period; and validating the corrected prediction based on a result of the comparing step.

* * * * *